US006213026B1

(12) United States Patent
Coester et al.

(10) Patent No.: US 6,213,026 B1
(45) Date of Patent: Apr. 10, 2001

(54) PROPULSION PLATE CONNECTOR SYSTEM FOR A PNEUMATICALLY PROPELLED VEHICLE

(75) Inventors: Oskar Hans Wolfgang Coester; Claudio Faraó Souza Pinto; Carlos Antonio Campani, all of Porto Alegre (BR)

(73) Assignee: Aeromoval Global Corporation (KY)

( * ) Notice: Subject to any disclaimer, the term of this patent is extended or adjusted under 35 U.S.C. 154(b) by 0 days.

(21) Appl. No.: 09/118,352

(22) Filed: Jul. 16, 1998

(51) Int. Cl.[7] ..... B60M 13/00
(52) U.S. Cl. ..... 104/155; 104/140
(58) Field of Search ..... 104/155, 156, 104/157, 158, 159, 160, 161, 140

(56) References Cited

U.S. PATENT DOCUMENTS

| | | | | |
|---|---|---|---|---|
| 3,722,424 | * | 3/1973 | Van Veldhuizen | 104/161 |
| 4,587,906 | * | 5/1986 | Coester | 104/156 |
| 4,658,732 | * | 4/1987 | Coester | 104/156 |
| 5,845,582 | * | 12/1998 | Coester et al. | 104/156 |

* cited by examiner

*Primary Examiner*—S. Joseph Morano
*Assistant Examiner*—Robert J. McCarry, Jr.
(74) *Attorney, Agent, or Firm*—Donald L. Beeson

(57) ABSTRACT

An improved propulsion plate connector system for a pneumatically propelled vehicle of a pneumatic transportation system includes a vertical pylon for connecting a propulsion plate in an air duct of a vehicle guideway to a wheel truck of the vehicle at a pylon joint proximate the wheel truck. The pylon and pylon joint fix the rotational position of the propulsion plate about the vertical axis of the pylon and position the propulsion plate in approximate vertical alignment with a wheel axis of the wheel truck, such that the propulsion plate remains substantially centered in the air duct when the vehicle truck passes through horizontal curves in the guideway. The pylon joint also permits vertical articulation of the wheel truck relative to the pylon and propulsion plate to maintain traction between the vehicle truck wheels and the guideway track as the wheel truck enters and exits vertical curves in the guideway. A horizontal stabilizing beam extending between the wheel truck and undercarriage to stabilize the vehicle against bending moments produced by horizontal propulsive forces generated at the propulsion plate is further preferably connected to the top end of the pylon at a stabilizing beam joint that permits horizontal articulation of the stabilizing beam relative to the vehicle wheel truck, thereby allowing the wheel truck to negotiate horizontal curves without rotation of the propulsion plate about the vertical axis of the pylon.

27 Claims, 15 Drawing Sheets

PROPULSION PLATE CONNECTOR SYSTEM FOR A PNEUMATICALLY PROPELLED VEHICLE

BACKGROUND OF THE INVENTION

The present invention generally relates to pneumatic transportation systems wherein vehicles are pneumatically propelled along a vehicle guideway by one or more vehicle propulsion plate extending into an air duct of the guideway. The invention more particularly relates to the manner of connecting a propulsion plate to a pneumatically propelled vehicle, and has particular application in respect to vehicles having horizontal stabilizing beams on the underside of the vehicle for counter-balancing torsional forces transmitted to the vehicle from the propulsion plate.

U.S. Pat. No. 4,658,732 issued to Oskar H. W. Coester (the Coester '732 patent) discloses a pneumatic transportation system wherein vehicles capable of transporting freight or passengers are propelled along an elevated vehicle guideway having an enclosed air duct beneath a trackway support platform. The vehicle is propelled by pneumatic propulsion forces acting against a propulsion plate in the guideway air duct, which in turn is connected to one of the vehicle's wheel trucks by a mast or pylon that passes through a longitudinal sealed guide slot in the guideway support platform. Also disclosed is the use of a horizontal stabilizing or traction beam connected between the pylon and the underside of the vehicle body to counteract the bending moment produced at the top of the vertical pylon by the horizontal propulsion forces on the propulsion plate attached to the bottom of the pylon. This beam reduces the tendency of the pneumatic propulsion forces to lift the vehicle truck wheels from the track, thereby increasing traction or contact between the track and the vehicle. This is especially important in transportation systems of this type, since the vehicles are relatively light as compared to vehicles having onboard motors or other onboard power sources.

While the pneumatically propelled vehicle shown in the Coester '732 patent would perform suitably along straight sections of guideway, its disclosed use of a stabilizing beam is not practical for pneumatic transportation systems having a guideway configuration employing horizontal curves. Specifically, the disclosed rigid connection between the stabilizing beam and propulsion plate of the vehicle would prevent the pylon from rotating with the wheel truck as the wheel truck enters a curve thereby preventing rotation of the wheel truck. The rigid connection between the pylon and stabilizing beam and the vehicle's wheel trucks would also cause the wheels of the wheel trucks to lose contact with the tracks of the guideway when the wheel trucks enter and exit vertical curves due to the inability of the wheel trucks to freely follow changes in gradients in the trackway.

Another difficulty with the wheel truck design shown in the Coester '732 patent relates to its conventional placement of the propulsion plate in a centered position relative to the wheel truck, that is, midway between truck wheels. This centered position results in small misalignments between the propulsion plate and air duct in horizontal curves of the guideway as well as misalignments between the vertical pylon and the support platform guide slot. These temporal misalignments require compensations in the sizing of the propulsion plate and guide slot which increase air leakage and reduce system efficiency. Furthermore, failure to keep the propulsion plate and pylon centered relative to the air duct and guide slot as the vehicle negotiates a horizontal curve increases wear on the seals of the propulsion plate and guide slot.

The present invention provides an improved propulsion plate connector system which overcomes the above-mentioned problems of propulsion plate and pylon alignment as a vehicle negotiates curved sections of the vehicle guideway of a pneumatic transportation system. The invention provides a mechanism for connecting the propulsion plate to the wheel truck of a pneumatically propelled vehicle in a manner that permits the vehicle to freely negotiate horizontal and vertical curves while maintaining contact between the truck wheels and the trackway, and while keeping the propulsion plate and its connecting pylon in a true centered position relative to the air duct and guide slot. Using the pylon connector system of the invention, a propulsion plate can be designed closer to the dimensions of the air duct (that is, with very small gaps between the edges of the propulsion plate and the walls of the guideway) resulting in reduced air flow across the propulsion plate. Maintaining a centered pylon as it passes through the guide slot will also reduce air leakage through the slot seal and slot seal wear.

SUMMARY OF THE INVENTION

Briefly, the invention involves an improved propulsion plate connector system having a vertical pylon which connects a propulsion plate in the air duct of a vehicle guideway to a wheel carriage structure of a vehicle pneumatically propelled on the guideway. One aspect of the invention also involves the use of a horizontal stabilizing beam connected between the pylon and the vehicle to counteract torque about the top of the pylon produced by propulsion forces on the propulsion plate.

In accordance with the invention, the top end of the pylon is connected to the wheel carriage of the vehicle at a pylon joint that fixes the rotational position of the pylon and the propulsion plate relative to the wheel carriage such that the propulsion plate follows the travel of the wheel carriage as the wheel rotates in a horizontal curve. Typically the wheel carriage will be in the form of a convention wheel truck having two wheel sets defining two wheel axes, however, a wheel carriage structure for a single wheel set could also be used, such as with relatively short vehicles which are also relatively light.

In one aspect of the invention, a horizontal hinge joint connects the base end of the stabilizing beam to the top end of the pylon proximate the pylon joint to permit horizontal articulation of the stabilizing beam relative to the wheel carriage so as to permit the propulsion plate connected to the pylon to follow horizontal curves in the air duct of the vehicle guideway. In another aspect of the invention, the pylon joint provides a vertical pivot joint which permits the pylon to pivot in the longitudinal vertical plane so as to permit the wheel carriage to maintain contact in vertical curves in the vehicle guideway. The pylon joint and the hinge joint for the horizontal beam preferably provide for both vertical and horizontal articulation to permit the vehicle to readily negotiate both vertical and horizontal curves.

In a further aspect of the invention, the pylon joint is located proximate the wheel axis of one of the wheel sets of the wheel carriage so as to position the propulsion plate connected to the bottom end of the pylon in approximate vertical alignment with the wheel axis. In yet another aspect of the invention both the pylon and the propulsion plate are positioned in approximate vertical alignment with the wheel axis. As hereinafter described in greater detail, such approximate alignment of the propulsion plate and the pylon with the axis of one of the wheel sets of a wheel carriage such as a two axle wheel truck, instead of centering the pylon and propulsion plate between the wheel sets, will minimize deviations from the optimum centered position of the propulsion plate and connecting pylon as the propulsion plate and pylon pass through a horizontal curve in the vehicle guideway.

In still a further aspect of the invention, the pylon joint joins the top of the pylon to a static wheel axle on a wheel carriage at a location that is proximate to and in front of the wheel axle such that the pylon joint and wheel axle are in the same approximate horizontal plane. Such positioning of the pylon joint will facilitate disassembly of the pylon and propulsion plate from the wheel axle for maintenance purposes and will reduce the longitudinal forces transmitted to the axle by propelling forces on the propulsion plate. In accordance with another aspect of the invention, the top end of the pylon is joined to a static axle of the wheel carriage by cushioning means for providing a degree of isolation between the propulsion plate assembly and the pneumatically propelled vehicle. Bracing means connected across the wheel carriage are also provided for reducing loads on the wheel truck's static axle.

The present invention also includes a method of propelling a vehicle of a pneumatic transportation system through curves in the guideway of the transportation system including fixing the propulsion plate in the guideway air duct so that it is in approximate vertical alignment of a wheel axis of a wheel carriage of the vehicle as the wheel carriage travels through a horizontal curve of the guideway.

Therefore, it will be seen that it is a primary object of the present invention to provide an improved propulsion plate connector system for a pneumatically propelled vehicle of a pneumatic transportation system which permits efficient operation of the pneumatically propelled vehicles in curved sections of the guideway. It is another object of the invention to provide an improved propulsion plate connector system which allows the propulsion plate of the pneumatically propelled vehicle to remain centered in the air duct of the vehicle guideway when negotiating horizontal curves. It is a further object of the invention to reduce wear on the seals used around the perimeter of a propulsion plate of a pneumatically propelled vehicle, as well as minimizing wear on the seals used in the guide slots of the guideway's support platform. It is yet a further object of the invention to provide an improved propulsion plate connector system that permits the vehicle's propulsion plate to easily disconnect from a wheel truck or other wheel carriage of the vehicle for maintenance and inspection purposes. Other objects of the invention will be apparent from the following specification and claims, as well as from the accompanying drawings.

DETAILED DESCRIPTION OF THE ILLUSTRATED EMBODIMENT

Figure 1:
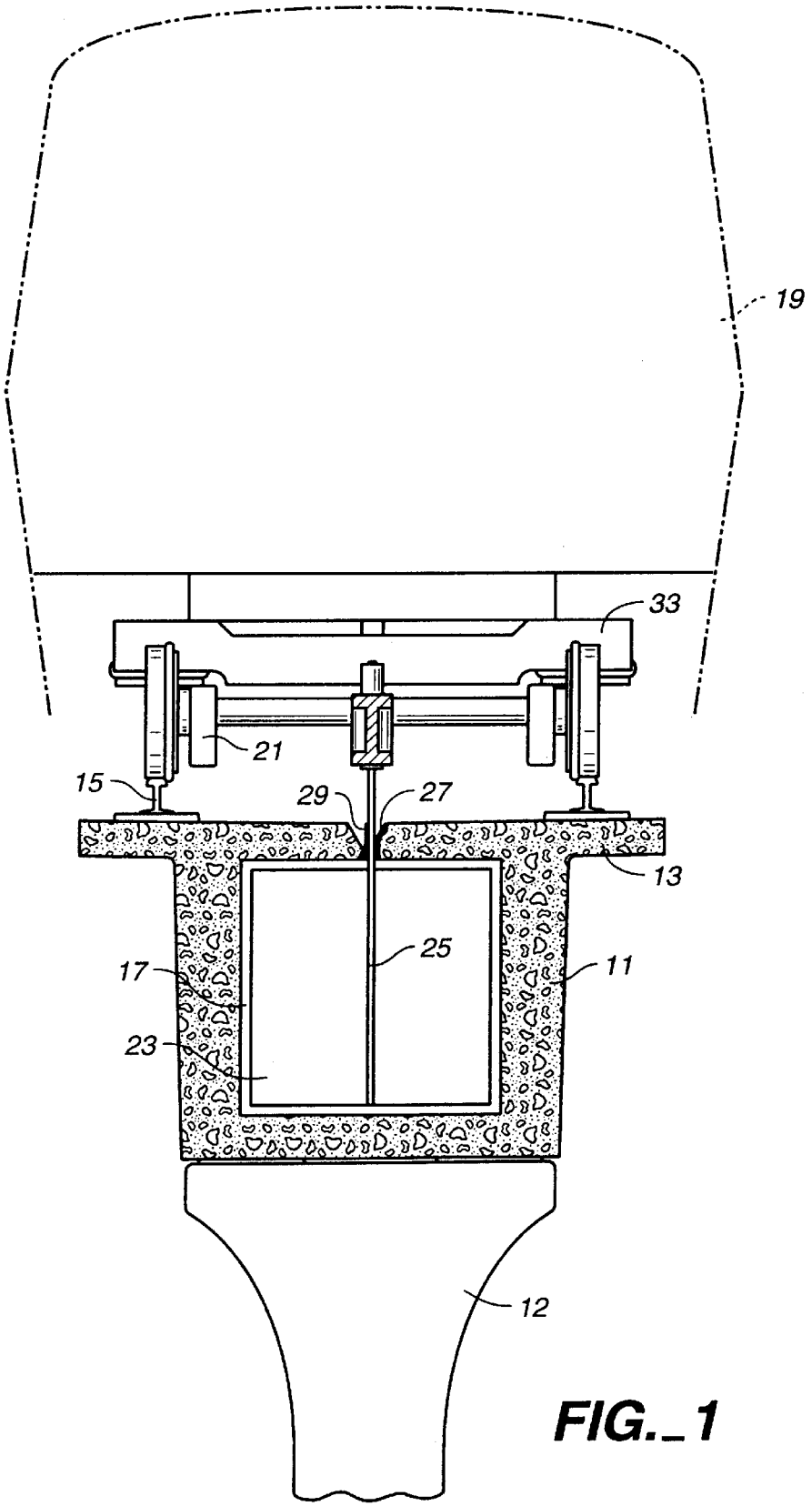
FIG. 1 is a cross-sectional view of a vehicle on an elevated guideway of a pneumatic transportation system as seen from lines 1—1 in FIG. 2, and generally illustrates a propulsion plate in the air duct of the guideway connected to a wheel truck of the vehicle.
Figure 2:
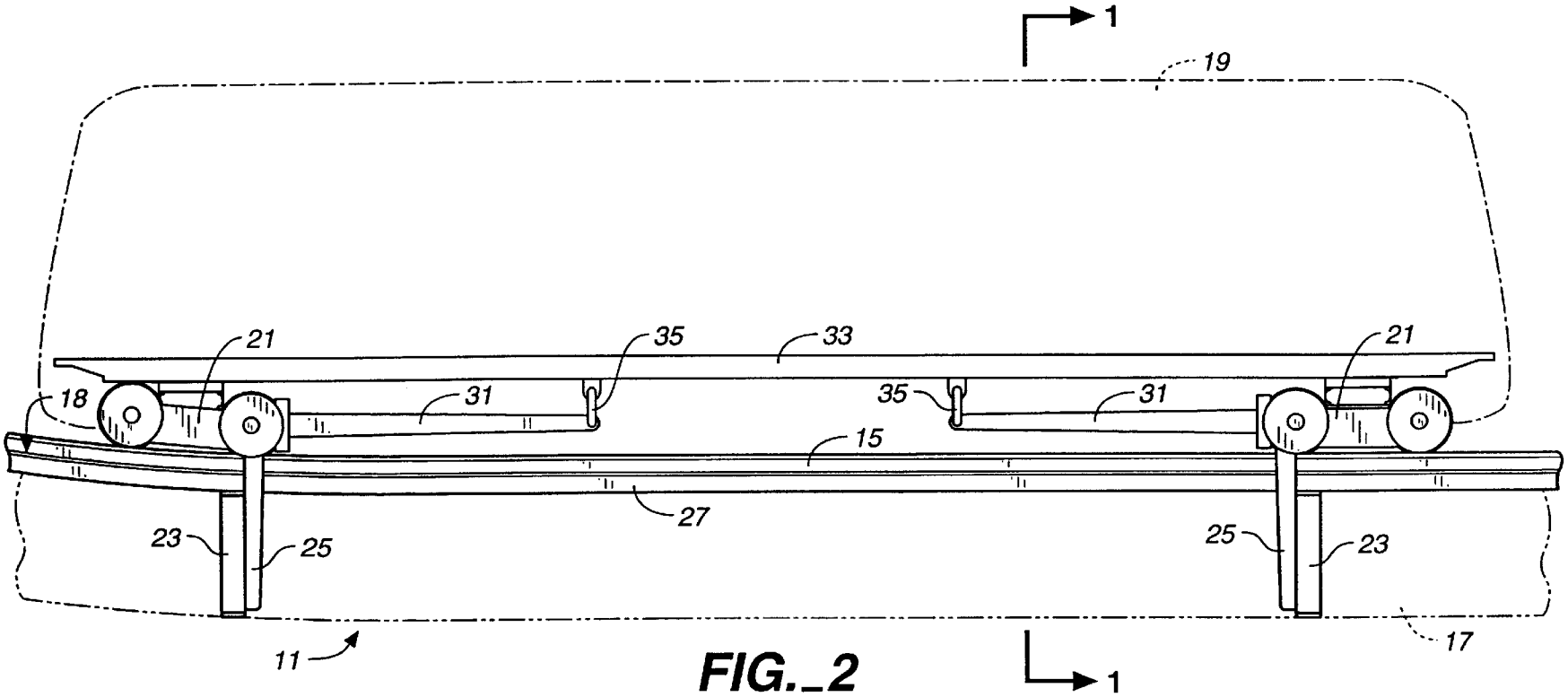
FIG. 2 is a pictorial view of the vehicle and vehicle guideway of FIG. 1, further showing a slight vertical curve at the left end of the guideway.

Referring now to the drawings, the improved propulsion plate connector system of the invention is used to connect a propulsion plate to the wheel carriage of a vehicle of a pneumatic transportation system such as pictorially illustrated in FIGS. 1 and 2. Referring to FIGS. 1 and 2, a vehicle guideway 11, suitably fabricated in pre-cast concrete sections and elevated above the ground on suitable tower structures 12, includes an upper support platform 13, a track 15 on the upper support platform, and an enclosed air duct 17 beneath the support platform. A vehicle 19 having a body 20, undercarriage 33, and wheel carriage structures in the form of wheel trucks 21 is propelled along the track of the guideway by means of a propulsion plate 23 positioned crosswise and moveable within the air duct. The propulsion plate is connected to the vehicle's wheel trucks on the underside of the vehicle by means of a flat vertical pylon 25 aligned with and passing through a guide slot 27 in the guideway's support platform 13. Propulsion forces are generated against propulsion plate 23 by controlling air flow states in the guideway's air duct by a system of distributed air flow generators such as described in prior U.S. Pat. No. 4,587,906. To prevent air leakage through the pylon guide slot 27, the guide slot is provided with suitable sealing flaps 29 which are deflected as the pylon passes through the guide slot.

As shown in FIG. 2, it is contemplated that, for a long vehicle, a propulsion plate 23 will be provided at each end of the vehicle, one for each wheel truck 21 located at the extremities of the vehicle. A horizontal stabilizing beam 31 is connected to and extends inwardly from each of the wheel trucks, with the distal ends 32 of the stabilizing beams being connected to the bottom of the vehicle undercarriage 33 by means of swivel joints 35. The stabilizing beams 31 function to counteract the bending moments produced on the propulsion plate pylons 25 by the propulsion forces exerted against the propulsion plate. Such bending moments are transmitted directly to the vehicle undercarriage through the horizontal beams, rather than being exerted on the connecting structure between pylons 25 and wheel trucks 21. It will be understood that, while a separate stabilizing beam is shown for each wheel truck, it would be possible to provide a common stabilizing beam for both wheel trucks in the case of shorter vehicles. In this case each end of the beam would be connected to a wheel truck without a direct connection to the vehicle's undercarriage.

The positioning of the propulsion plate 23 in reference to the vehicle's wheel trucks 21 and the manner of connecting the propulsion plate and stabilizing beam to the wheel trucks is vitally important to the ability of the vehicle to operate in a transportation system having sections of guideway with horizontal and vertical curves, as well as straight sections of guideway. To understand this importance, the performance of the vehicle in both straight and curved sections of guideway will now be described in reference to FIGS. 3–7.

Figure 3:
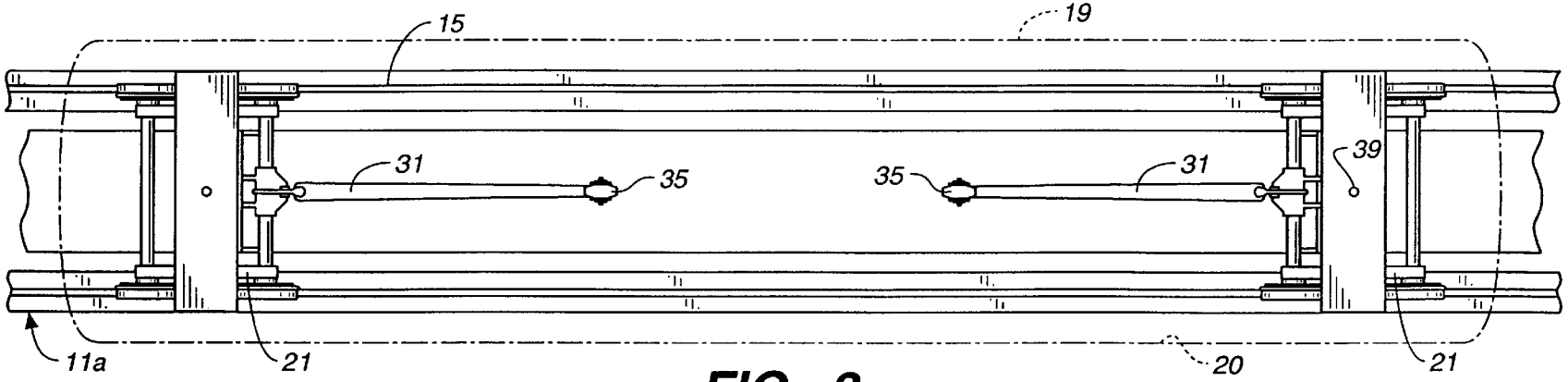
FIG. 3 is a pictorial top plan view of the wheel trucks of the pneumatically propelled vehicles shown in FIGS. 1 and 2, travelling on a straight section of the vehicle guideway.
Figure 4:
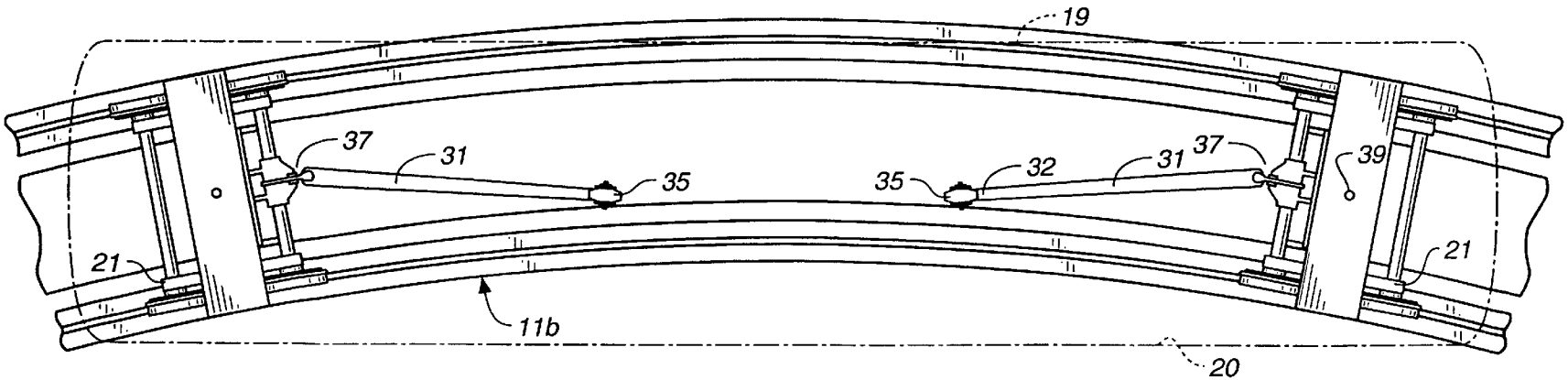
FIG. 4 is a pictorial top plan view of the wheel trucks of the vehicle shown in FIG. 3, traveling on a section of vehicle guideway having a horizontal curve, and showing the horizontal articulation of the stabilizing beams connected between the vehicle's propulsion plate pylons and the undercarriage of the vehicle as it negotiates the horizontal curve.
Figure 5:
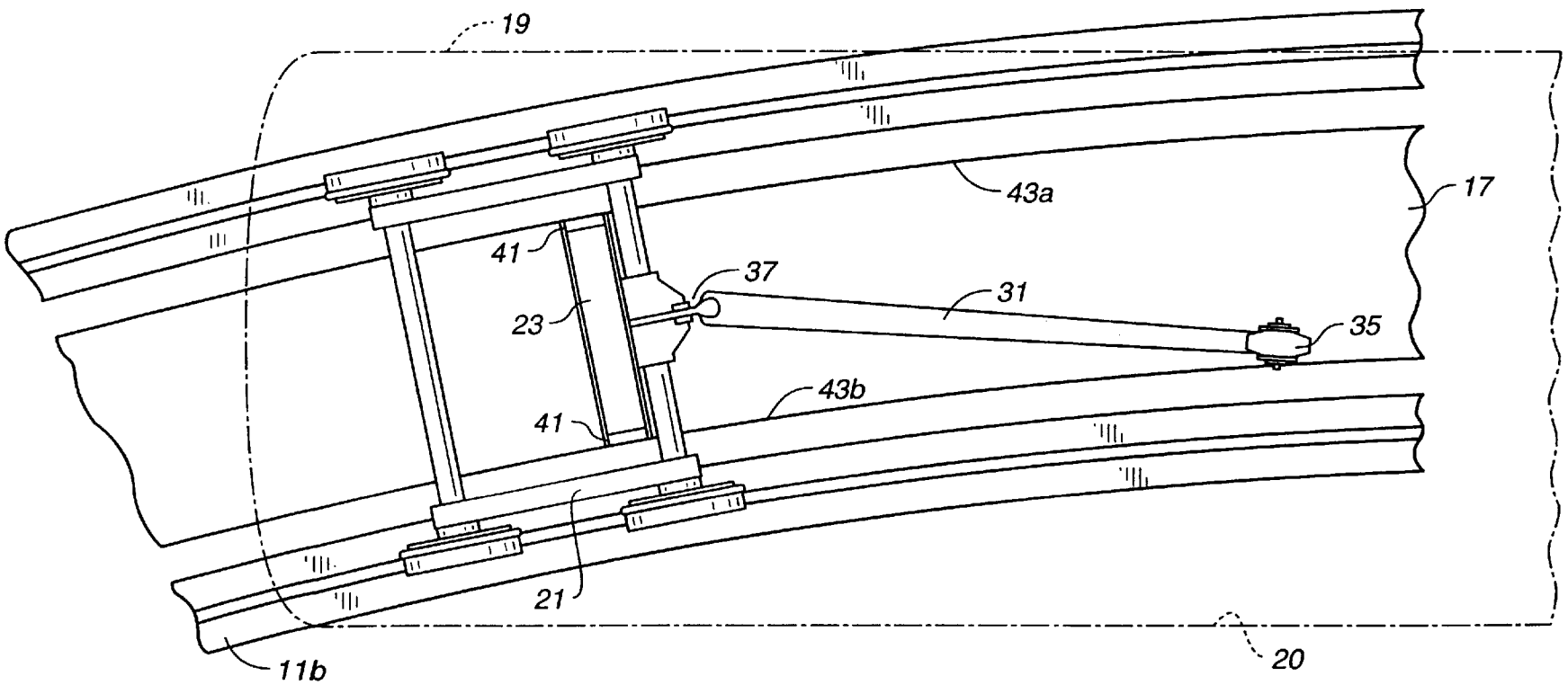
FIG. 5 is an enlarged pictorial view of one of the wheel trucks of the vehicle shown in FIG. 4 negotiating the horizontal curve of guideway, and illustrating in greater detail the alignment of the propulsion plate in the air duct of the guideway.

FIG. 3 shows wheel trucks 21 of vehicle 19 traveling in a straight section 11*a* of the guideway, whereas FIGS. 4 and 5 show the vehicle traveling through a guideway section 11*b* having a horizontal curve. In the straight guideway section 1 la, wheel trucks 21 of vehicle 19, along with the horizontal stabilizing beams 31, are aligned with the vehicle undercarriage 33 and the vehicle body 20 which is shown in phantom lines. However, as the vehicle enters a horizontal curve as shown in FIGS. 4 and 5, horizontal beams 31 articulate in the horizontal plane at beam joints 37, thereby allowing the wheel trucks to rotate about bolster pins 39 relative to the vehicle body 20. (As described below, the distal ends 32 of the horizontal beams do not move in a horizontal plane.) Without such horizontal articulation, the vehicle 19 would be unable to enter the curved section of guideway since the horizontal beams would prevent the wheel trucks from rotating in the turn.

FIG. 5 pictorially shows a portion of one of the vehicle's rotated wheel trucks 21 and reveals the position of the propulsion plate 23 in a curved portion of the guideway's air duct 17. It can be seen that the propulsion plate has a rotationally fixed position relative to the wheel trucks such that it remains in a perpendicular orientation relative to the air duct 17 as the wheel truck passes through the curve. By maintaining this squared position relative to the air duct, the propulsion plate structure remains relatively centered in the air duct such that the gap between the edges 41 of the propulsion plate and the air duct sidewalls 43*a*, 43*b* remain constant.

Figure 6:
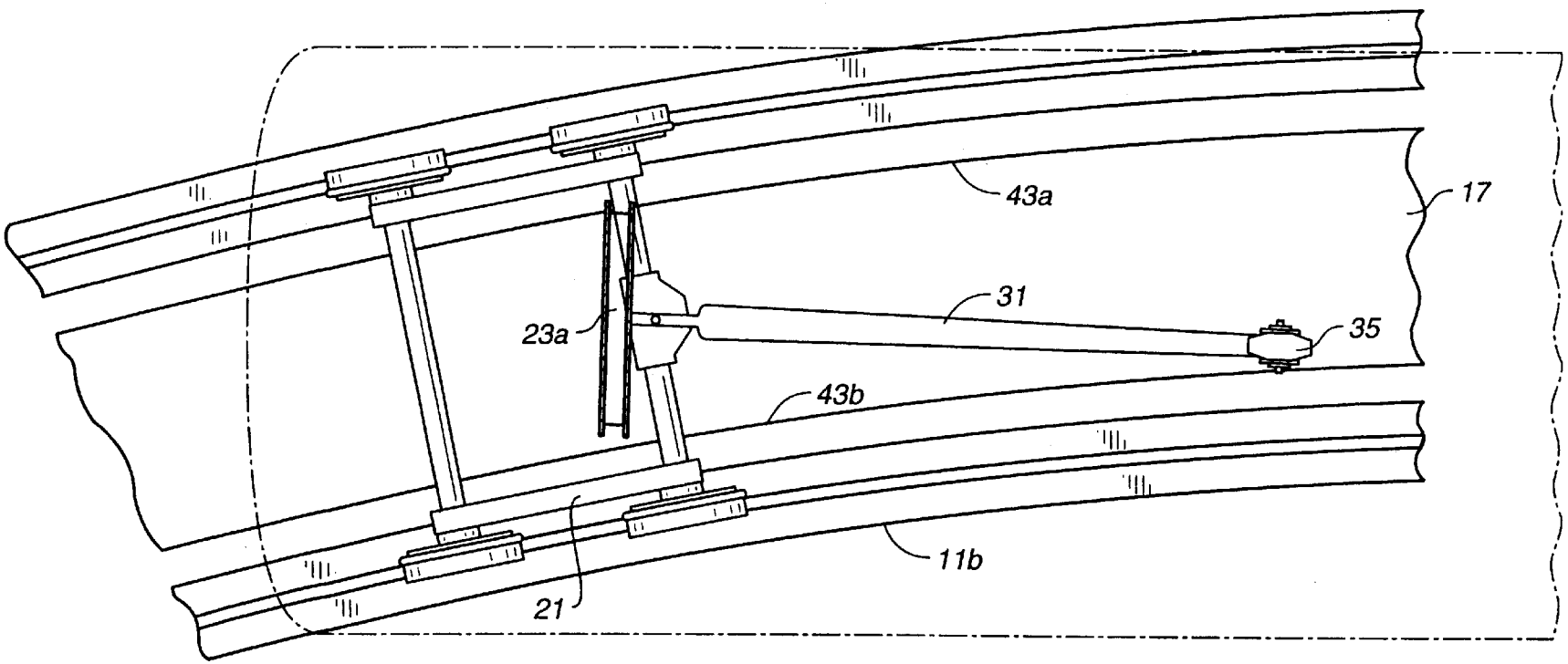
FIG. 6 is a pictorial top plan view of a wheel truck of a pneumatically propelled vehicle negotiating a curved section of guideway, and illustrating the interference between the propulsion plate and sidewalls of the guideway air duct that would occur if the propulsion plate were allowed to rotate with vehicle's horizontal stabilizing beams.

FIG. 6 illustrates the consequences of allowing the propulsion plate to rotate relative to wheel truck 21 as the wheel truck enters a horizontal curve of the guideway. In FIG. 6, wheel truck 21 has a propulsion plate 23*a* that rotates with the horizontal beam 31. As illustrated, such rotation of the propulsion plate would cause the propulsion plate to interfere with the air duct sidewall 43*a* on the outside of the curve, and to produce a gap between the propulsion plate and the sidewall 43*b* on the inside of the curve. To accommodate anticipated rotations of the propulsion plate in systems having guideway curves, the rotating propulsion plate shown in FIG. 6 would have to be undersized in relation to the width of the air duct. As mentioned above, such reduced sizing of the propulsion plate would increase air leakage across the propulsion plate resulting in lower system efficiency. Such a configuration would also cause uneven wear on the seals used around the edges of the propulsion plate.

Figure 7:
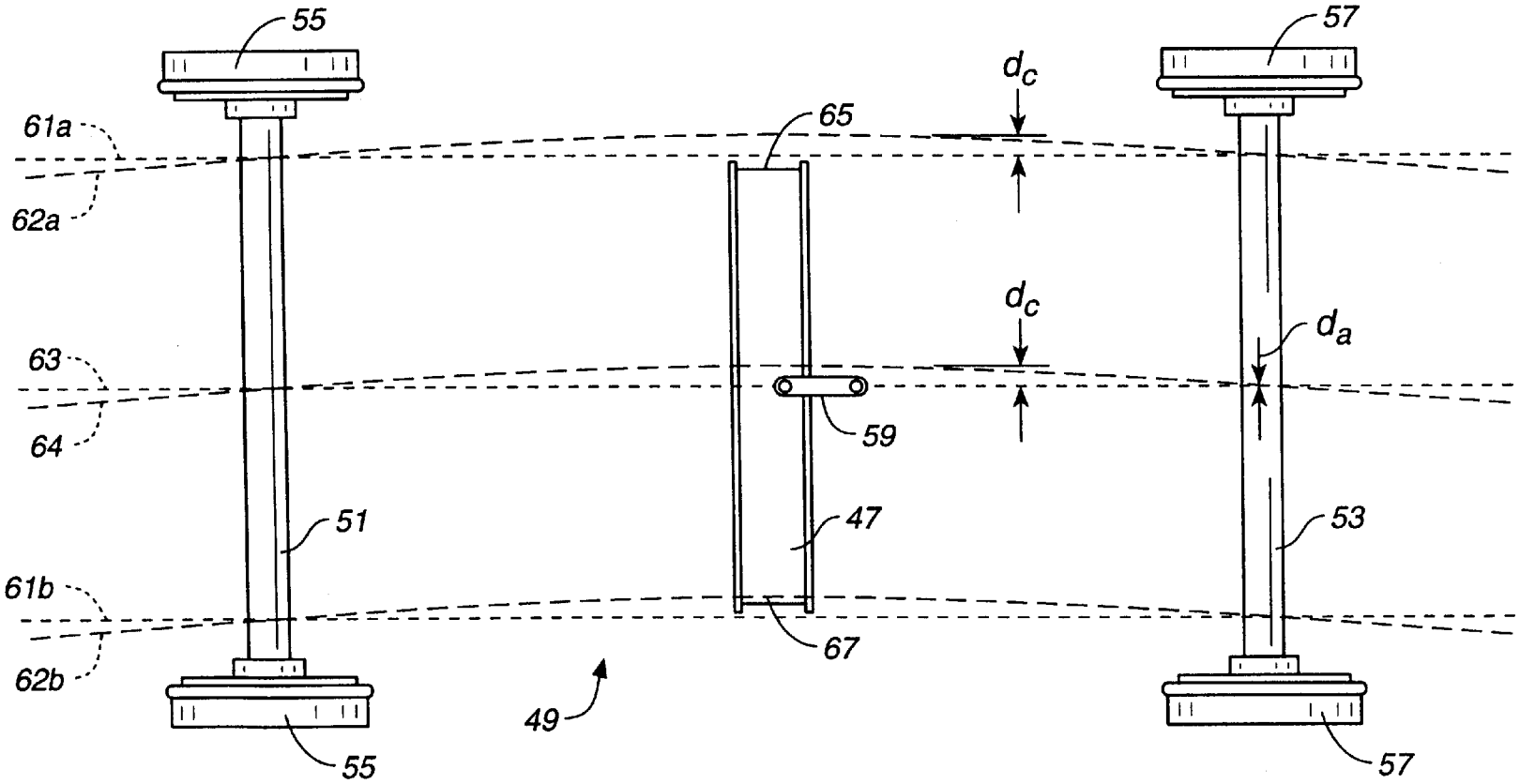
FIG. 7 (PRIOR ART)
FIG. 7 is a pictorial view of a prior art configuration of a wheel truck and pylon wherein the pylon is connected centrally of the wheel truck, and illustrating the deviation of the propulsion plate and pylon from a true centered position relative to the guideway and guideway slot.

FIG. 7 pictorially illustrates the disadvantage of conventional approaches to attaching propulsion plates to the wheel trucks of a pneumatically propelled vehicle. In FIG. 7, a propulsion plate 47 is connected to the underside of wheel truck 49 midway between static axles 51, 53 for wheel sets 55, 57. The propulsion plate is connected to the wheel truck by means of vertical pylon 59 which is centered between the two lateral edges 65, 67 of the propulsion plate in order to align the pylon with the longitudinal guide slot of the guideway's support platform as generally illustrated in FIG. 1. In a straight section of guideway, such as illustrated in FIG. 3, propulsion plate 47 and pylon 59 are centered relative to the air duct sidewalls (represented in FIG. 7 by dashed lines 61*a* and 61*b*), and the pylon is centered relative to the guide slot represented by dashed line 63. However, in a curved section of guideway (such as shown in FIG. 4) having curved sidewalls represented by phantom lines 62*a*, 62*b*, the propulsion plate, though perpendicular to the air duct, will experience a lateral deviation from its normally centered position in the air duct as represented by arrows "$d_c$". A similar deviation will occur between the pylon and curved guide slot 64. This deviation from a true centered position will cause problems similar to those described in connection with the propulsion plate configuration shown in FIG. 6, that is, the propulsion plate must be sized to accommodate this deviation, thereby increasing the gaps between the air duct and the propulsion plate and air flow across the propulsion plate. Similarly, the deviation of the pylon 59 from a true centered position will require a wider guide slot with increased air leakage and increased wear on the guide slot seals. As hereinafter described, the present invention provides for relocating the propulsion plate and pylon to a position close to the inboard static axle 53 of wheel truck 49. With such relocation, the positional deviations experienced in horizontal curves between the actual position of the propulsion plate and pylon and a true centered position in the air duct is essentially zero as indicated by arrows "$d_a$". With such placement of the propulsion plate and pylon, leakage across the propulsion plate is again minimized with a resulting improvement in system efficiency. This will also have the benefit of reducing vibration and noise cause by such air flows. Further, by keeping the propulsion plate's nominal width as large as possible, more surface area is available for the generation of a propulsion thrust against the propulsion plate by pressurized air flow in the air duct.

FIGS. 8–13 illustrate structure of the invention for connecting the propulsion plate and propulsion plate pylon to the inboard wheel axle of the vehicle's wheel truck as pictorially illustrated in FIGS. 1–5, and for also connecting the horizontal stabilizing beam to this structure. In accordance with the various aspects of the invention, the connecting structure allows for the horizontal articulation of the stabilizing beam 31 in relation to the wheel truck to which it is connected, as well as the vertical articulation of the set formed by the horizontal beam and pylon in a longitudinal vertical plane as the wheel truck enters vertical curves of a guideway, such as the vertical curved portion 18 of guideway 11 shown in FIG. 2. When the vehicle enters vertical curves, the differences in gradient encountered by the vehicle and each of the vehicle's wheel trucks cause the wheel trucks to turn in the vertical longitudinal plane in relation to the connection to the vehicle body. Vertical articulation between the propulsion plate and horizontal beam in relation to the vehicle's wheel truck, as herein described, allows for this freedom of movement. Without vertical articulation, the rigid connection between the pylon, wheel truck and horizontal beam would inhibit the ability of the wheel truck to follow vertical curves, thereby reducing traction or contact between the wheel sets in the guideway track, and would place severe strain on the system components.

It will be appreciated that the required degree of vertical articulation between the propulsion plate pylon and wheel truck will be relatively small as compared to the required horizontal articulation of the horizontal stabilizing beam, due to the relatively large radii experienced in vertical curves as compared to horizontal curves. It is anticipated the articulation range in the vertical plane will typically be limited to approximately 8 degrees (4 degrees either side of vertical), whereas horizontal articulation of the horizontal beam will typically be in the range of 26 degrees (13 degrees to each side of the center axis of the vehicle).

Figure 8:
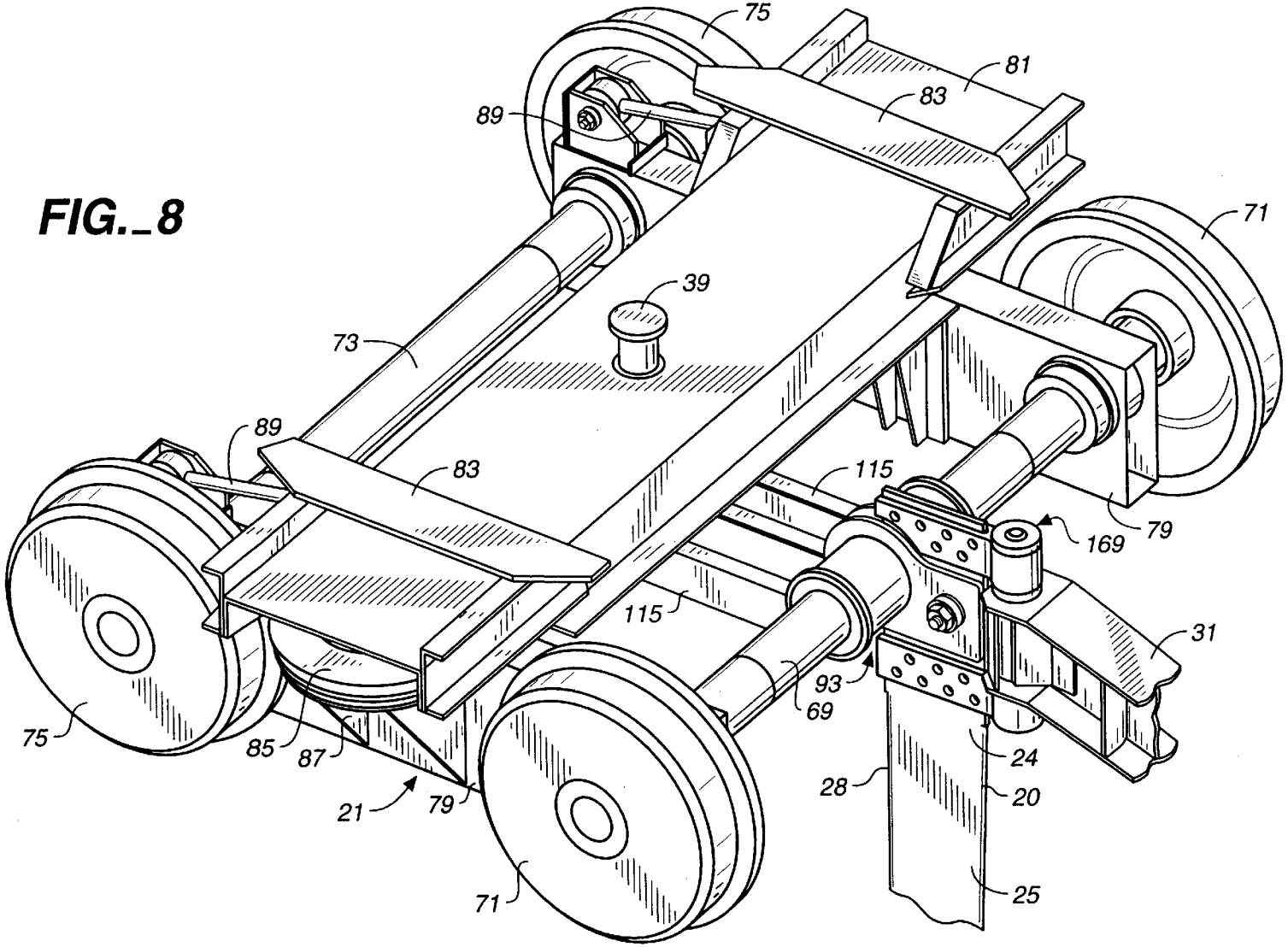
FIG. 8 is a top perspective view of a vehicle wheel truck having an improved propulsion plate connection system accordance with the invention.
Figure 9:
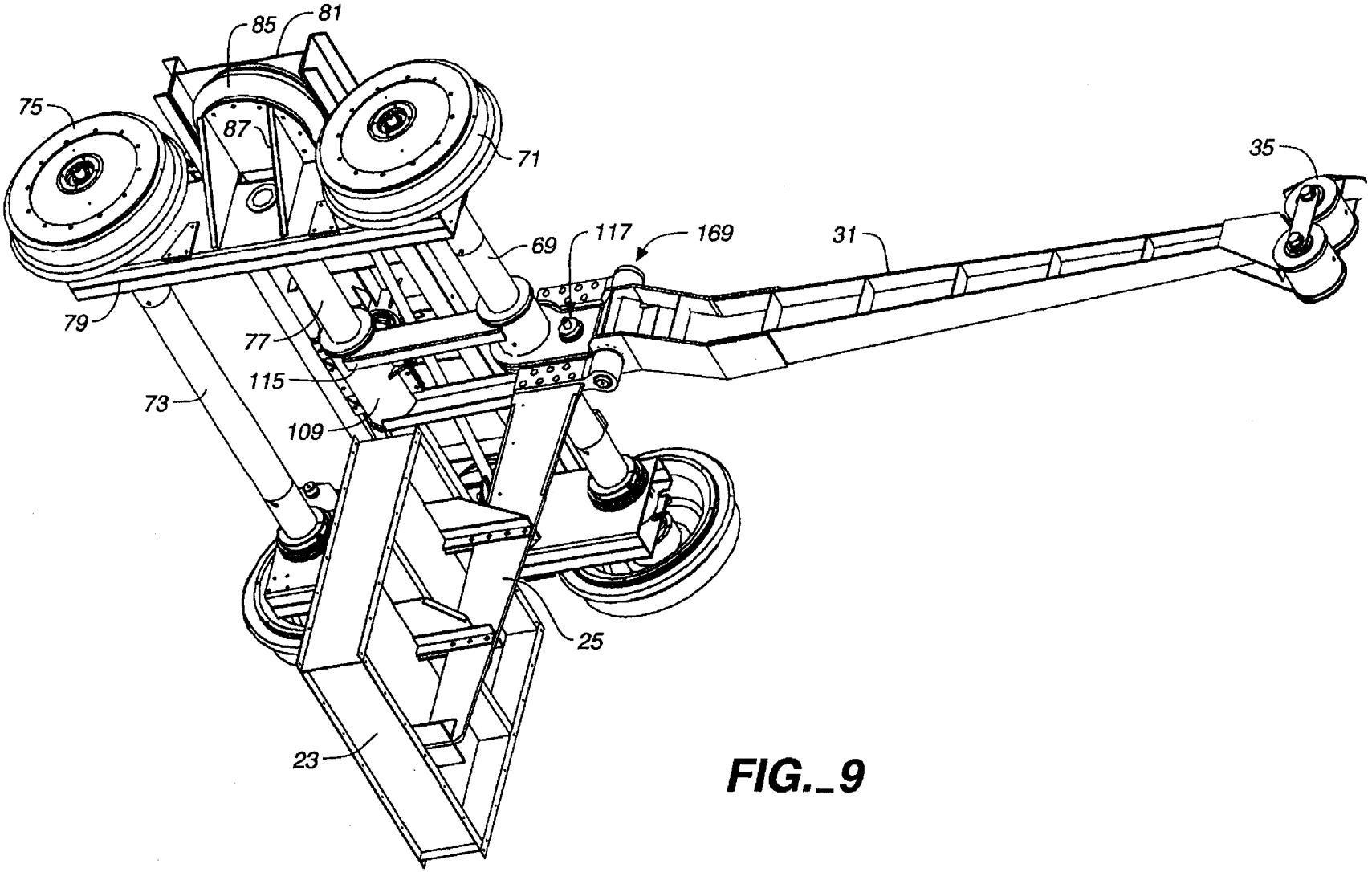
FIG. 9 is a bottom perspective view of the wheel truck shown in FIG. 8, and also showing the full extension of the stabilizing beam connected to the undercarriage of the vehicle.

Referring to FIG. 8, each of the vehicle's wheel trucks includes a transverse inboard static axle 69 for inboard wheel set 71 and a transverse outboard static axle 73 for outboard wheel set 75. The static axles 69, 73, along with a crossbeam 77, extend between longitudinal side beams 79 to form a rigid frame for supporting a transverse suspension beam 81. The suspension beam, which has slide plates 83 for engaging and supporting the undercarriage of the vehicle, is in turn supported and held in place by air springs 85 mounted to bracket structures 87 extending laterally from each of the truck's side beams. A connecting rod assembly 89 mounted to the side beams holds the suspension beam in place while allowing the beam a degree of vertical motion on the air springs. A connection between the wheel truck and the undercarriage of the vehicle is made by bolster pin 39 which allows the truck to rotate relative to the vehicle body.

The vertical pylon 25 has a top end 24 for connecting the propulsion plate to the static axle 69 as hereinafter described. It also has an extended bottom end 26 for connecting to the propulsion plate 23 in the air duct, and beveled edges 28 intermediate its top and bottom ends to facilitate passage of the pylon through the guideway slot seal (see FIG. 1). It is noted that the propulsion plate 23 is attached in offset relation to pylon 25 such that the pylon leads the propulsion plate on the inboard side of the vehicle. This offset construction has the advantage of allowing the pylon to pass through the slot seal on the side of the propulsion plate opposite the side of the pneumatic propulsion force as more particularly described in U.S. Pat. No. 4,658,732. With such a construction, air leakage through the slot seal is minimized due to the lower pressure differentials between atmosphere and the inboard side of the propulsion plate as compared to its propulsive force side.

Also, the rigid structure formed by pylon 25 and propulsion plate 23 is preferably centered below the wheel axis formed by static axle 69 so that the pylon and propulsion plate is each in approximate vertical alignment with the wheel axis. By centering this structure in relation to the wheel axis, lateral deviations of the propulsion plate and pylon in the guideway air duct and guide slot in horizontal curves can be minimized as illustrated in FIG. 7.

The top end of pylon 25 is connected to inboard static axle 69 by means of a pylon connector assembly 93 which permits a small degree of articulation of the pylon in the longitudinal vertical plane relative to the wheel truck 21. This connector assembly also provides for a cushioned connection between the wheel truck and the pylon that acts to dampen noise and vibrations generated at the propulsion plate. The connector assembly is seen to include a pair of longitudinal connector plates 95 having ring-shaped axle ends 97 for capturing the centrally located collar assembly 99 surrounding the static axle. Suitably, the ends 97 of connector plates 95 are secured to the tubular outer metal jacket 101 of collar assembly 99 by welding the plates to the collar. This securement produces a unitary structure which holds the connector plates in their longitudinally extended position when the collar assembly is installed as hereinafter described.

As shown in FIGS. 9, 10, 10A, and 11, the pylon connector assembly 93 further includes a second, longitudinally displaced collar assembly 103 having outer split metal jacket 105 formed by upper and lower halves 107, 109 joined together at mating flanges 111, 113. Longitudinal bracing beams 115 rigidly join the outer jacket 101 of collar assembly 99 to the lower jacket half 109 of collar assembly 103, such that the collar assembly is spaced from collar assembly 99 a suitable distance to engage and clamp over the crossbeam 77 of the wheel truck. The bracing beams and second collar assembly provide bracing means connected to the wheel truck for reducing loads on the static axle by allowing a transfer of propulsion forces acting on the static axle 69 to the crossbeam of the truck, and provide vertical stabilization for the connection of the top end 24 of pylon 25 at the pivot pin assembly 119, which is in offset position in relation to the static axle 69. It will be appreciated that other designs for the bracing means are possible. For example, the bracing beams 115 could extend between the two static axles 69, 73 of the wheel truck, instead of between a separate crossbeam structure and the inboard static axle, or a different number of bracing beams could be used, including diagonal beams.

It can be seen that the top end of pylon 25 fits between the projecting ends 96 of connector plates 95 to form a pylon joint 117 which prevents any rotation of the pylon and propulsion plate about a vertical axis "A", but which permits a degree of vertical articulation of the pylon and propulsion plate about a horizontal axis. The vertical articulation of the pylon between the connector plates occurs about a pivot pin assembly 119 which is illustrated in greater detail in FIGS. 11 and 11A. The pivot pin assembly, which connects through pivot openings 121 at the projecting ends 96 of the connector plates and opening 120 at the top end of the pylon, includes a pivot pin 123 having a pivot shaft 125 and threaded end 127, suitable inner and outer bushings 129, 131, and a spacer 133 having conical surface 135 for receiving the conical end 126 of pivot pin shaft 125. Fastening nut 137 with backing washer 139 fastens to the threaded end 127 of the pivot shaft for fastening the pivot pin assembly together. An additional spacer 141 is provided between the connector plates to maintain a separation of parts.

Proper maintenance of the pylon connector assembly will require lubrication of the pivot pin assembly 119 and the contacting surfaces of connecting plates 95 and pylon 25. Lubrication can be supplied by a suitable grease applied to these components.

Figure 11A:
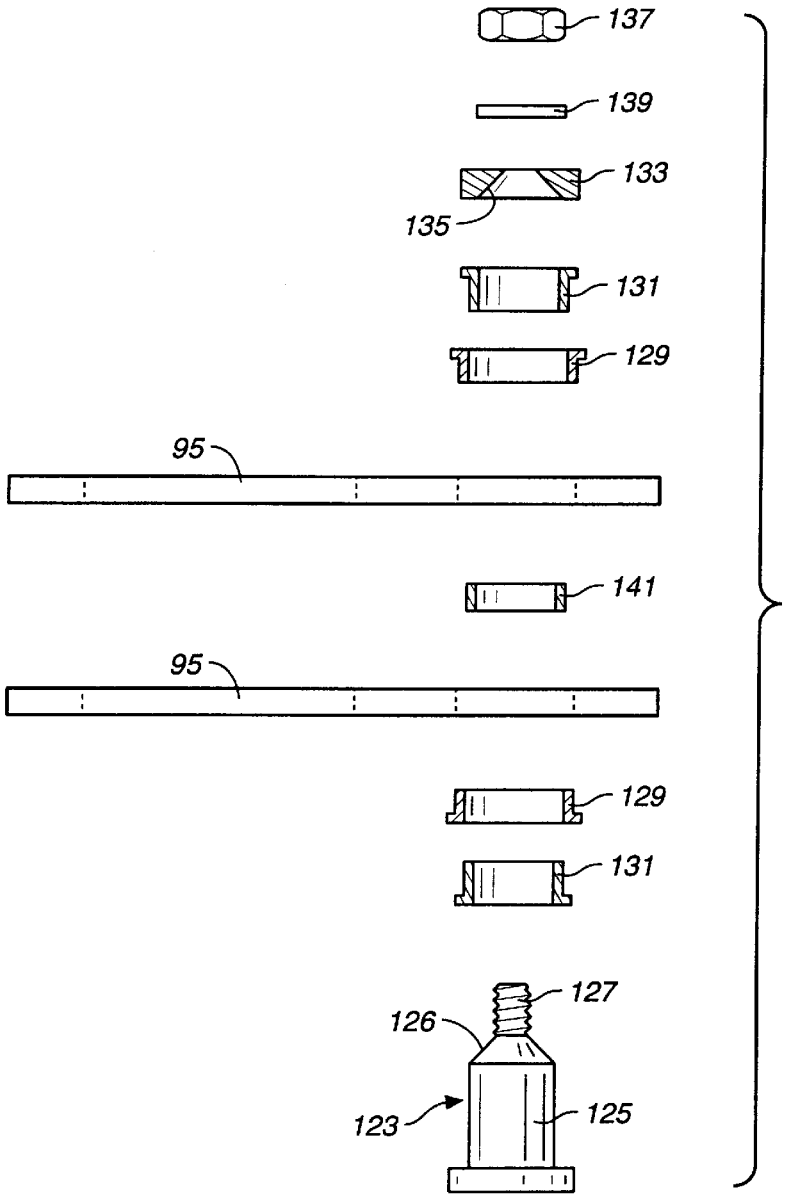
FIG. 11A is an exploded view of the horizontal pin assembly and axle connector plates which form the pylon joint of the propulsion plate connector system shown in FIG. 11.
Figure 12:
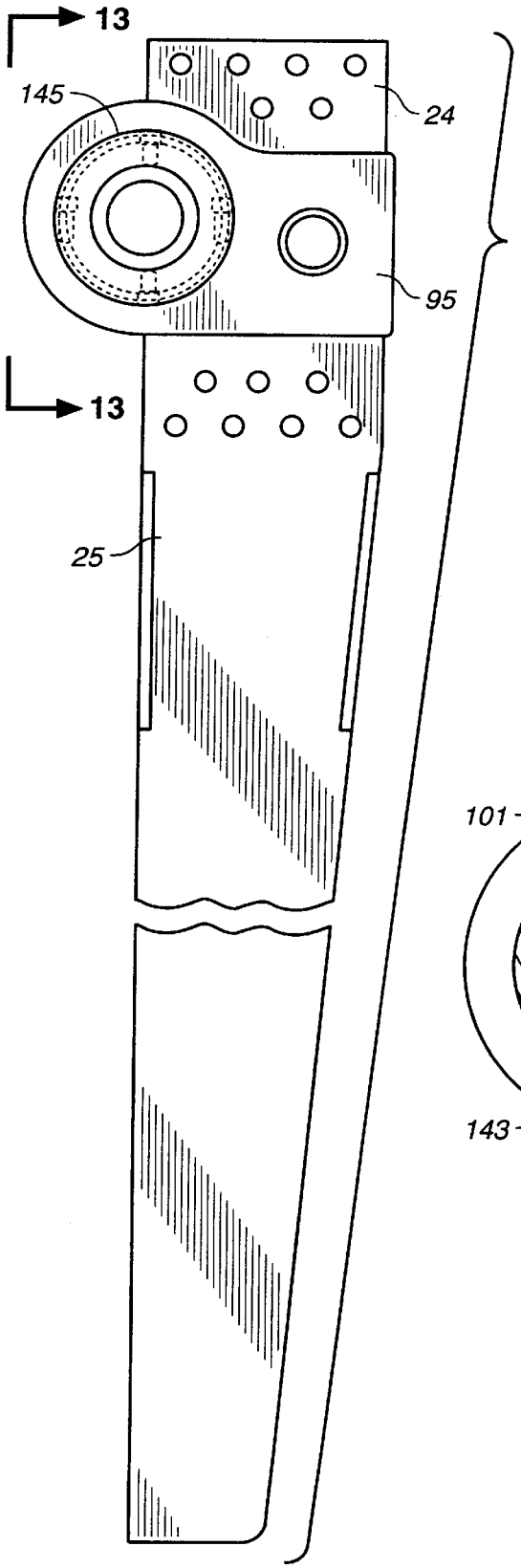
FIG. 12 is a side elevational view of the propulsion plate pylon, connector plates and collar assembly for holding the pylon to the static axle of the wheel truck.
Figure 12A:
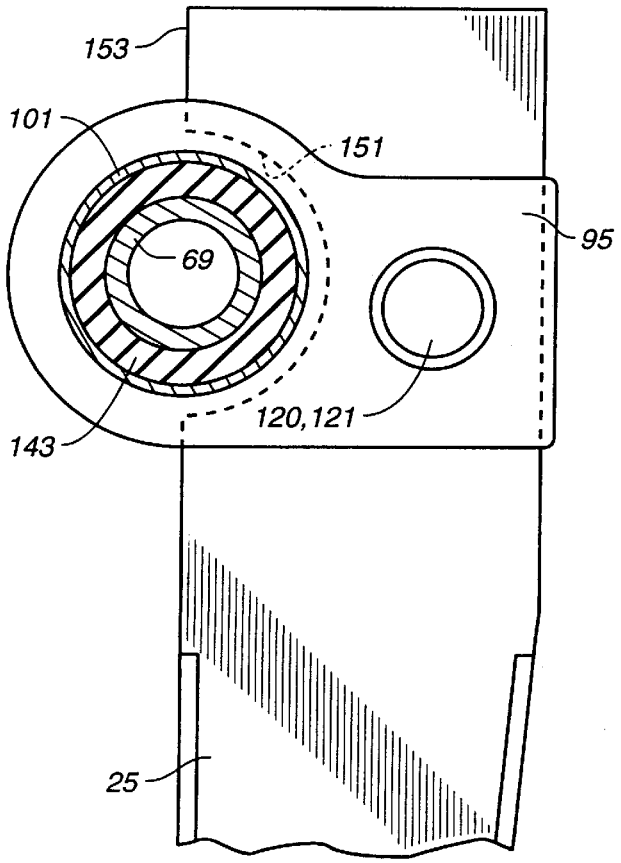
FIG. 12A is an enlarged cross-sectional view of the top of the pylon showing the axle connector plates and the axle collar assembly in cross-section taken along lines 12—12 of FIG. 13.
Figure 13:
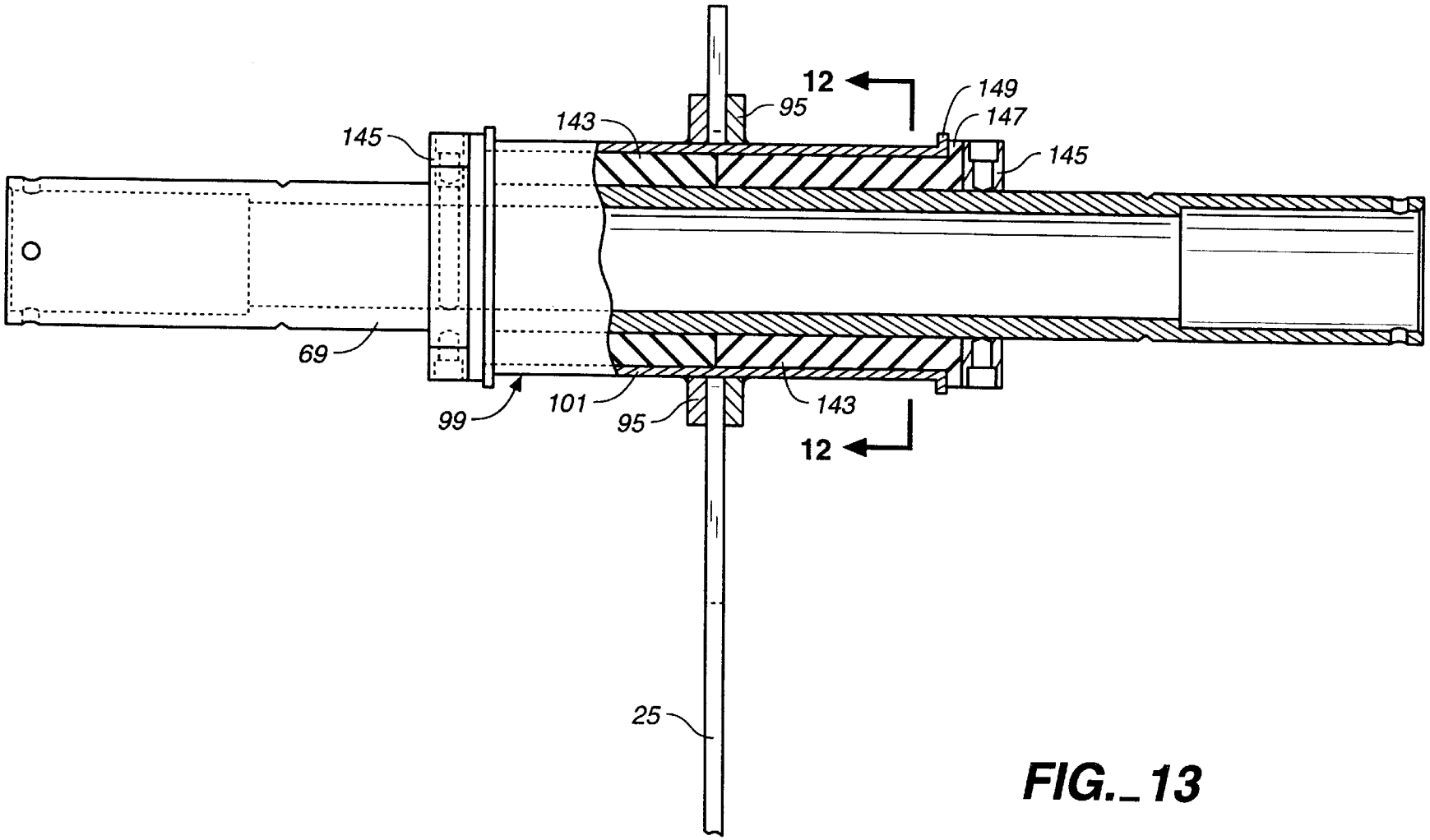
FIG. 13 is a side elevational view, in partial cross-section, of a static axle of a wheel truck and the axle collar assembly and axle connector plates holding the pylon thereto.

FIGS. 12, 12A and 13 show in greater detail the connection of the collar assembly 99 to the wheel truck's static axle 69. This collar assembly includes axially opposed, cylindrical cushion elements 143, suitably fabricated of neoprene rubber, inserted between the static axle and the collar assembly's metal jacket 101. End clamps 145 releasably clamp to the static axle for holding the collar assembly in its desired centered position on the axle. A radially extending shoulder portion 147 at the outer end of the cushion elements 143 provides a cushioning interface between clamps 145 and flanged ends 149 of the collar jacket 101. The cushion element thus provides a degree of mechanical isolation between the static axle and the outer metal jacket of the collar assembly to which the pylon 25 is held for absorbing vibrations generated by air flowing across the propulsion plate. It is noted that a recess 151 is provided in the top end of the pylon along the pylon's interior edge 153 to accommodate the outer cylindrical jacket of the collar assembly. This recess is provided with a sufficient radius to provide a gap between the collar jacket and the pylon (as illustrated by phantom lines in FIG. 11A) to permit rotational motion of the pylon in relation to the collar assembly.

The collar assembly 103 for wheel truck crossbeam 77 is similar in construction to the collar assembly for the static axle, except for its split jacket 105 as described above. This second collar assembly, which is shown in greater detail in FIGS. 10A and 11, also includes clamps 104 for holding the collar assembly in position on the crossbeam (see FIG. 10), and a cushion for providing isolation between the crossbeam and the collar assembly jacket 105, in this case in the form of axially split cushion elements 106. Using the cushioned collar assemblies 99, 103 to join the connector assembly 93 to wheel truck 21, suitable mechanical isolation between the propulsion plate and wheel truck can be achieved.

Installation of the collar assemblies requires removal of one of the wheels of wheel set 71 on the inboard static axle 69 so that the clamps 145, cushion elements 143, and jacket 101 of the first collar assembly 99 can be slipped over the axle. With the jacket 101 centered on the axle, the cushion elements can be inserted through the ends of the jacket and the clamps secured. However, before securing the clamps, the bracing beams 115 secured to jacket 101 are rotated until the lower half 109 of the jacket 105 of the second collar assembly 103, which is secured to the opposite ends of the bracing beams, engages crossbeam 77 so that the second collar assembly can be assembled around this beam.

Figure 14:
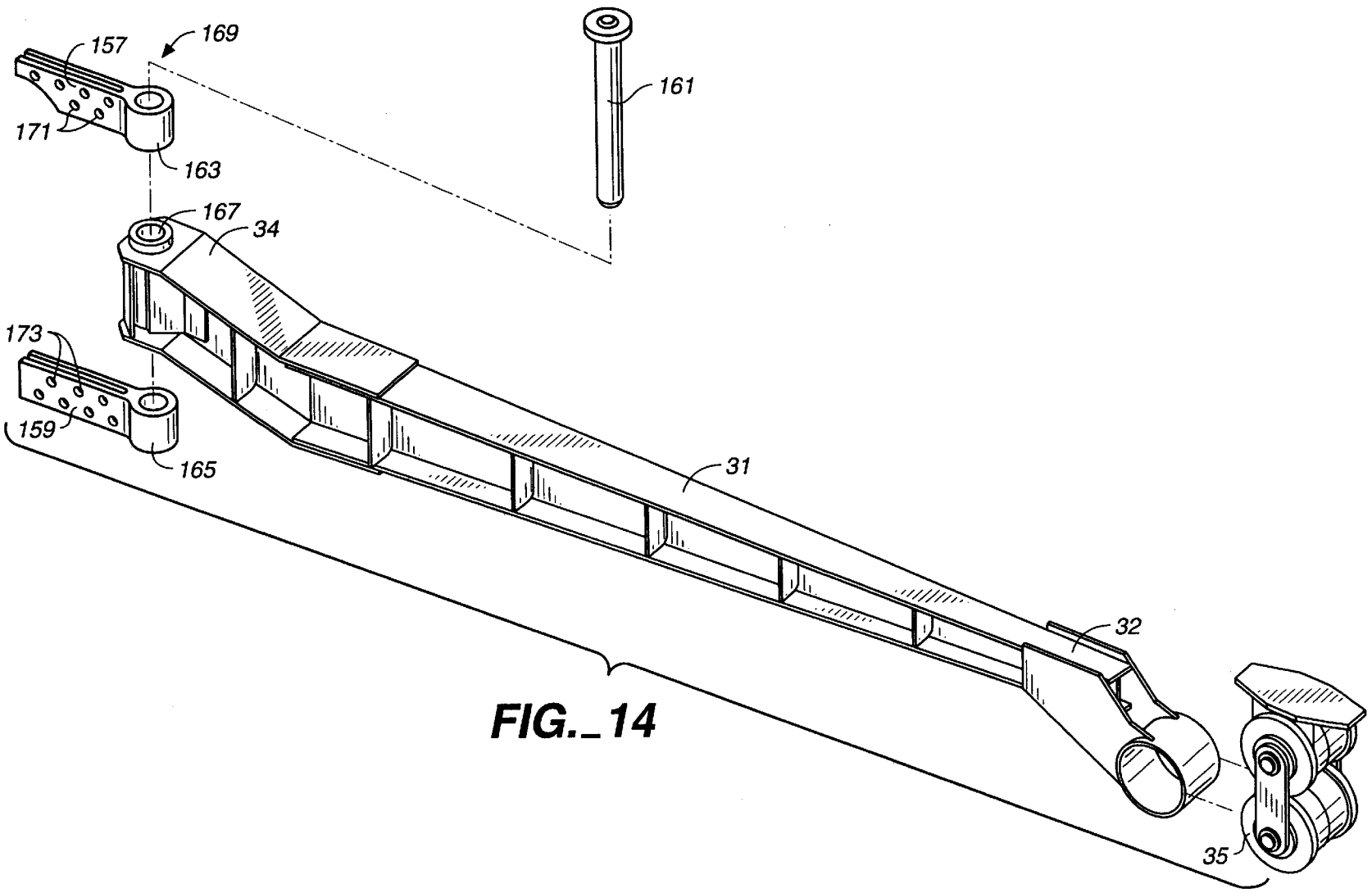
FIG. 14 is an exploded top perspective view of one of the horizontal stabilizing beams of the pneumatically propelled vehicle, showing the horizontal stabilizing beam joint for permitting horizontal articulation of the stabilizing beam relative to the pylon, and showing a swivel joint for attaching the pylon to the undercarriage of the vehicle.
Figure 16:
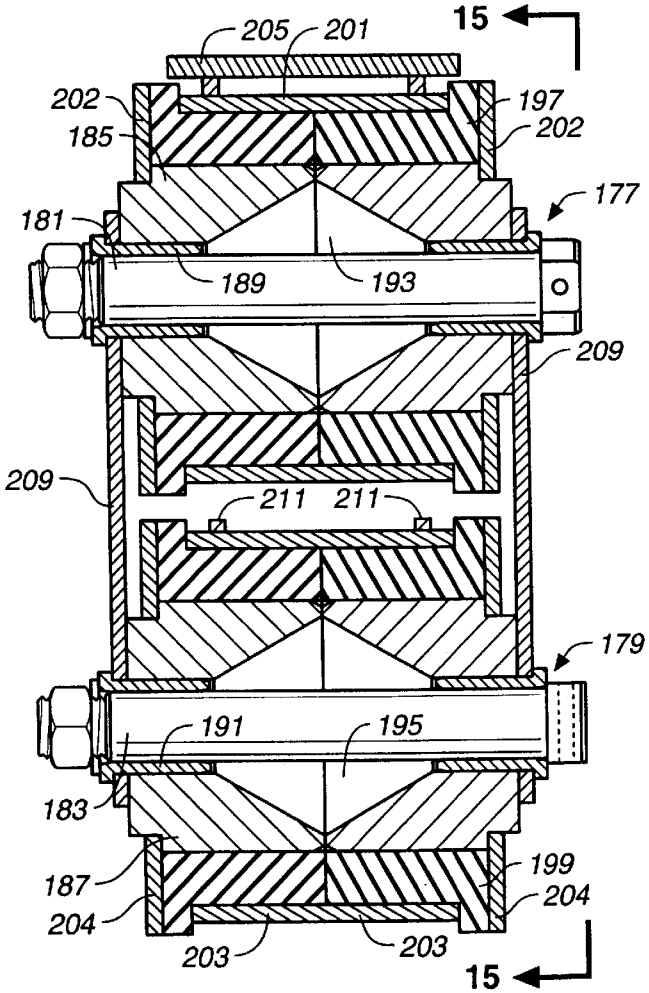
FIG. 16 is a cross-sectional view of the swivel joint shown in FIG. 15 taken along lines 16—16.

The structure for attaching the horizontal stabilizing beam 31 between the wheel truck 21 and the vehicle undercarriage will now be described in reference to FIGS. 13–16. Referring to FIGS. 13 and 14, the base end 34 of the stabilizing beam is joined to the top end of pylon end 25 by means of an upper and lower hinge bracket 157, 159, and a vertical hinge pin 161 which inserts through the hinge pin ends 163, 165 of the hinge brackets and pin sleeve 167 in the stabilizing beam base end 34. Thus connected, this hinge structure provides a stabilizing beam joint 169 proximate the pylon joint 117 which provides a horizontal pivot connection between the stabilizing beam and the pylon so as to permit horizontal articulation of the stabilizing beam relative to the vertical axis of the pylon. Suitable fastener holes 171, 173 are provided in the hinge brackets and pylon for fastening the hinge brackets to the pylon, such as by rivets or screw fasteners. Also, it is noted that the brackets are positioned above and below the connector plates 95 so as to produce a gap between the connector plates and brackets. Such a gap is necessary to allow for rotation of the pylon between the connector plates, albeit a small degree of rotation, whenever the wheel truck enters and exits vertical curves.

It can be readily appreciated that the base end 34 of the horizontal stabilizing beam can be readily detached from the pylon by simply removing hinge pin 161.

The stabilizing beam's distal end 32 is attached to the vehicle's undercarriage 33 by means of swivel joint 35, which allows for play of the stabilizing beam in the longitudinal direction as the stabilizing beam articulates about hinge joint 169. Also, the swivel joint permits small longitudinal displacements of the stabilizing beam that may otherwise occur when the wheel truck 21 rotates relative to the vehicle undercarriage. Since the stabilizing beam remains parallel to the vehicle body in a horizontal curve (see FIGS. 4 and 5), the only movement of the distal end 32 of the stabilizing beam is longitudinal; no movement is experienced about the vertical axis of the swivel joint and thus the swivel joint can be secured in a fixed position to the undercarriage of the vehicle.

Figure 15:
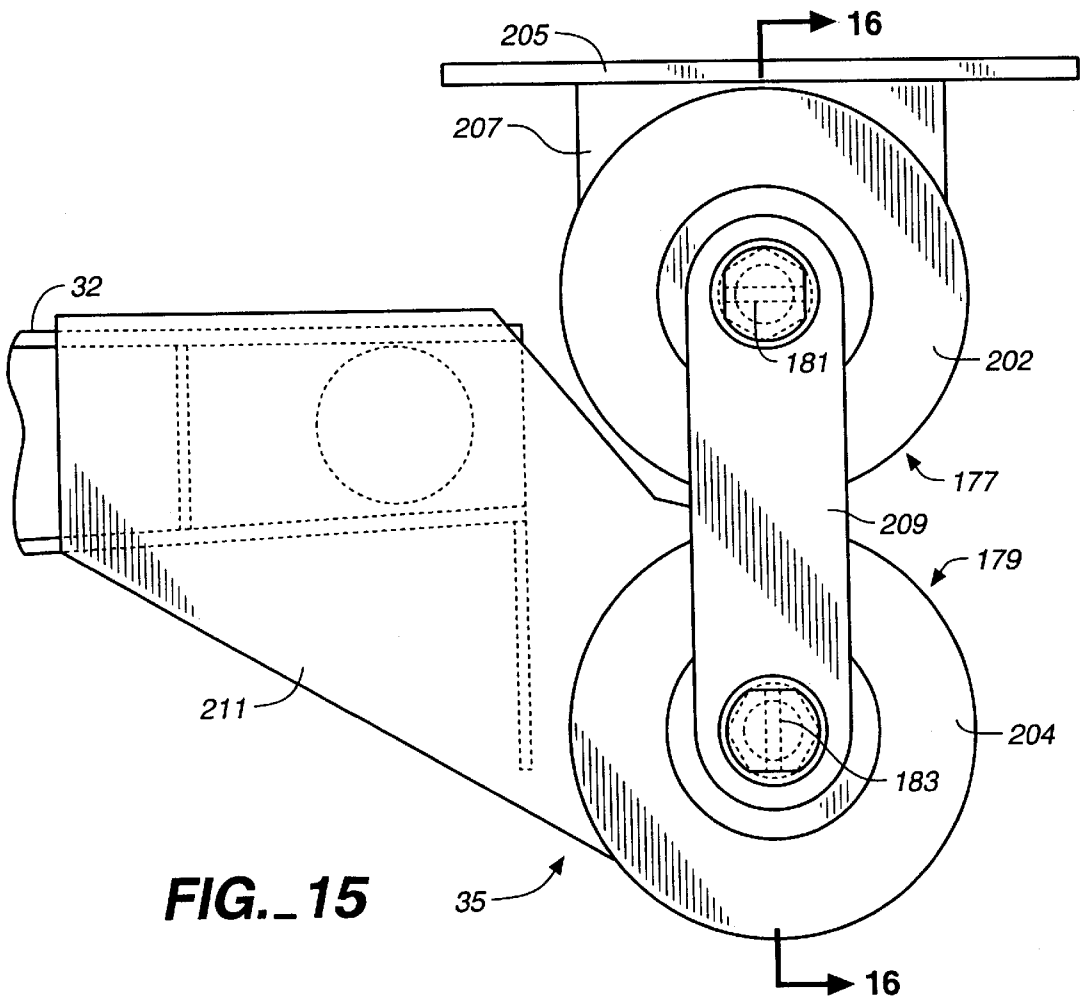
FIG. 15 is a side elevational view of the swivel joint for the horizontal stabilizing beam shown in FIG. 14.

Referring to FIGS. 14 and 15, swivel joint 35 includes upper and lower swivel block assemblies 177, 179, each of which includes a pivot pin 181, 183 extending through and supported in a pair of coaxial pivot pin blocks 185, 187 and pivot collars 189, 191. The abutting pin blocks of each swivel block assembly form an interior cavity 193, 195 for holding a suitable lubricant, and are surrounded by a pair of abutting rubber bushings 197, 199, suitably fabricated of a soft neoprene rubber, surrounded by outer cylindrical metal jackets 201, 203 and held by circular side plates 202, 204 which are welded to and radially extend from pivot pin blocks 177, 179. The upper pivot block assembly 177 is mounted to the undercarriage 33 of the vehicle by a mounting bracket structure consisting of mounting plate 205 and connecting brackets 207 welded together with the upper block assembly jacket 201. The lower swivel block assembly 179 is interconnected in swivel relation to the upper block assembly 177 by means of swivel plates 209 which connect to and are free to rotate about pivot collars 189, 191. Connecting plates 211 welded to the distal end 32 of the stabilizing beam are secured to the outer jacket 203 of the lower swivel block assembly of the swivel joint to provide the desired swivel connection between the beam and swivel joint.

Figures 10, 10A:
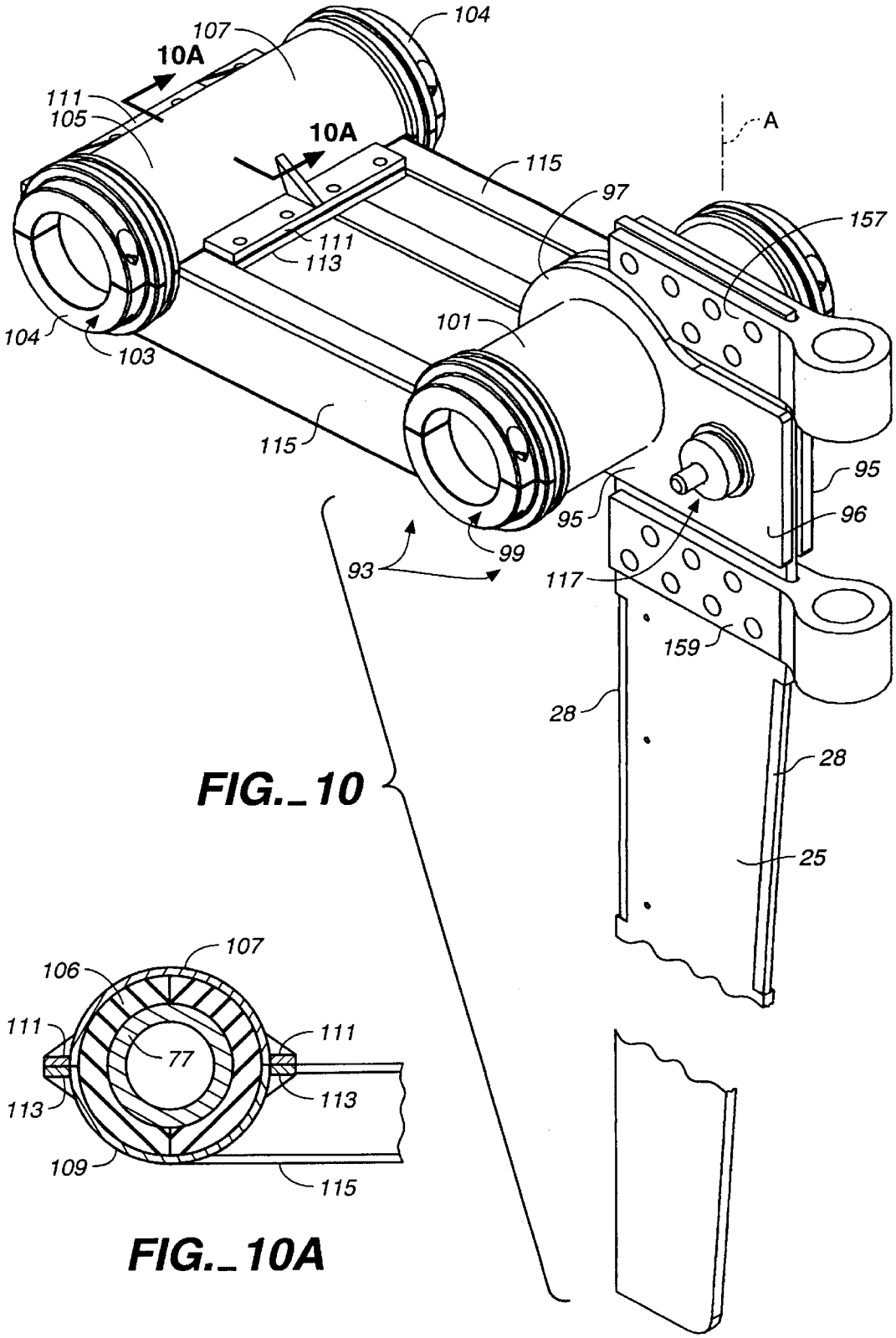
FIG. 10 is a top perspective view of a portion of the improved propulsion plate connector system of the invention, including collar assemblies for holding the pylon and propulsion plate to a static axle and crossbeam of the wheel truck.
FIG. 10A is a cross-sectional view of the collar assembly shown in FIG. 10 for the crossbeam of the wheel truck.
Figure 11:
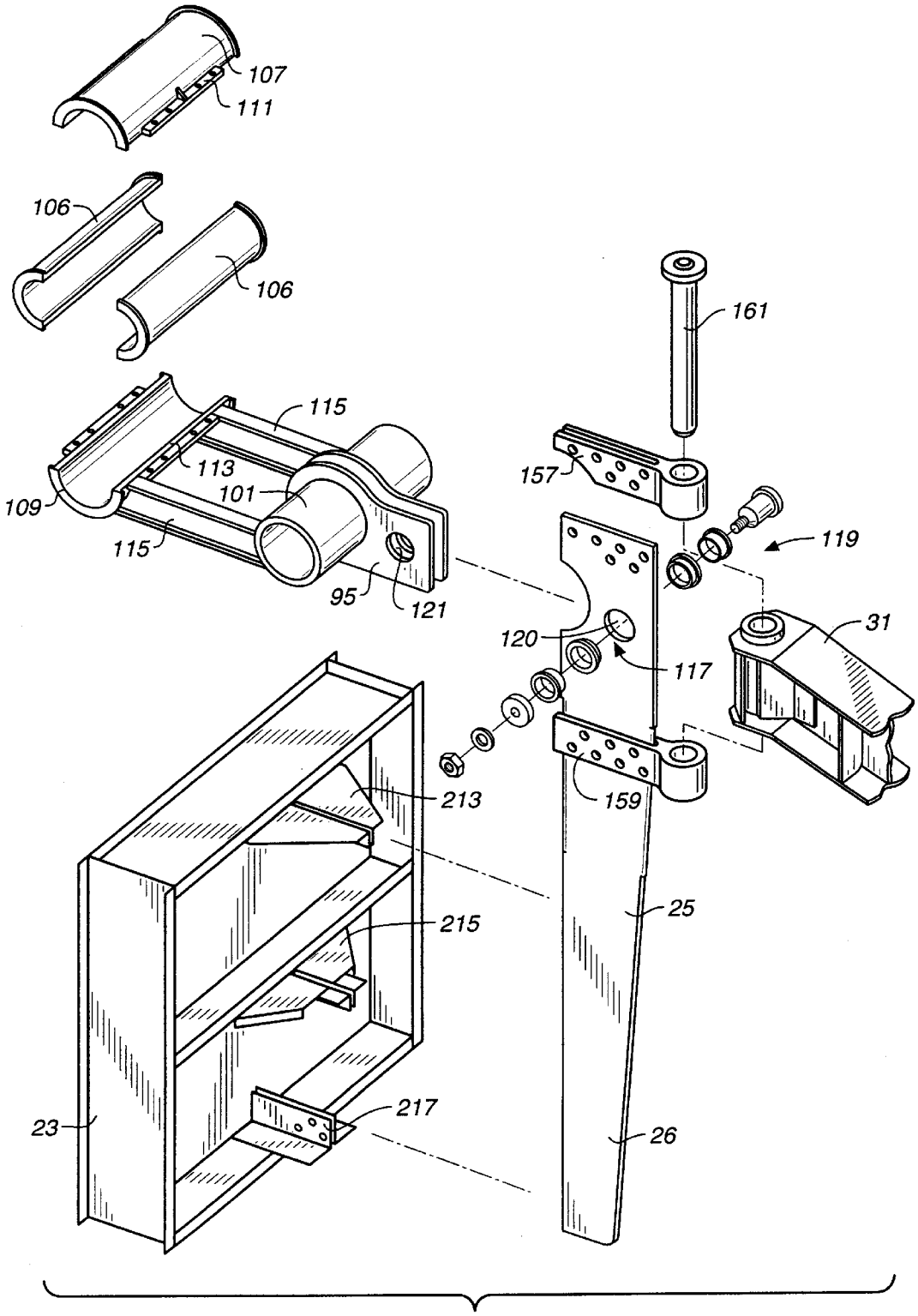
FIG. 11 is an exploded top perspective view of the improved propulsion plate connector system of the invention showing the pylon, propulsion plate, pylon joint and stabilizing beam joint.

Referring to FIGS. 8, 10 and 11, it can seen the pivot pin assembly forming the pylon joint 117 permits the pylon and propulsion plate to be readily detached from wheel truck 21 for maintenance and inspection. To detach the pylon, the base end of stabilizing beam 31 is first uncoupled from the pylon by removing hinge pin 161. The pivot pin of pivot pin assembly 119 is then removed and the vehicle moved forward on the track of the guideway to permit the top end of the pylon to slide out of connector plates 95. Because the pylon joint is positioned in front of the static axle 69 outside the wheel truck, the pivot pin will be relatively accessible from maintenance ports provided in the vehicle floor. Removal of the propulsion plate from the bottom of the pylon can similarly be accomplished through maintenance ports in the bottom of the vehicle guideway 11. The propulsion plate is detached from and reattached to the propulsion plate pylon brackets 213, 215, 217 as shown in FIG. 11.

The swivel joint is readily assembled and disassembled for maintenance and inspection by simply removing pivot pins 181, 183 and separating the parts of the swivel block assemblies, including the pivot pin blocks 185, 187 and the rubber bushings 197, 199.

Therefore, it can that the present invention provides an improved propulsion plate connector system for a vehicle of a pneumatic transportation system which permits the vehicle to readily negotiate horizontal and vertical curves in a vehicle guideway without sacrificing system efficiency, which reduces the transmission of noise and vibrations generated at the propulsion plate, and which facilitates inspection and maintenance of the component parts of the propulsion plate, pylon and connector assemblies. While the connector system has been described in considerable detail in the foregoing specification and accompanying drawings, it is understood that it is not intended that the invention be limited to such detail, except as necessitated by the following claims. For example, the desired positioning of the propulsion plate and pylon in approximate vertical alignment with the inboard static axle 69 of wheel truck 21 as herein described might alternatively be achieved by connecting the top end 24 of the pylon 25 directly to the inboard axle such that the pylon and stabilizing beam pivot in the longitudinal vertical plane about the axle itself, instead of a separate pivot point. Such a construction would reduce components—it would eliminate pivot pin assembly 119—and would reduce or eliminate the bending moment about the axle produced by having an offset between the pylon joint and axle, thereby eliminating the need of the longitudinal bracing beams 115 and second collar assembly. It will also be appreciated that the wheel trucks 21 can be constructed without static axles, but with wheel sets attached directly to the wheel truck frame. In this case, the placement of the propulsion plate and pylon in accordance with the invention would be in approximate vertical alignment with the axis of one of the wheel sets. Nor is it intended that the invention be limited to the use of a wheel truck having two wheel sets. The use of a truck with one or more than two wheel sets is possible.

Finally, it will be appreciated that the invention can be used with a vehicles having wheel sets mounted to single axle wheel carriage structures instead of to conventional two axle wheel trucks. Such an application might be used in transportation systems having relatively short vehicles where the vehicles can be adequately supported on two wheel sets involving just two single wheel axles and a suspension beam and bolster pin for each axle. In such vehicle designs the pylon connection would be made to the single axle of the wheel carriage structure in the same manner as described herein for vehicles having two axle wheel trucks. The connection could also be made as herein described to position propulsion plate and pylon in approximate vertical alignment with the single wheel axis of the wheel carriage to which the pylon is attached, to provide vertical articulation of the propulsion plate and horizontal stabilizing beam, if any, in the longitudinal vertical plane, and to also provide horizontal articulation of the horizontal beam relative to the wheel carriage structure.

What we claim is:

1. In a pneumatic transportation system which includes a vehicle guideway having a vehicle support platform, an air duct beneath said support platform, and a pylon guide slot in said support platform, and which further includes a pneumatically propelled vehicle having an undercarriage and at least one wheel carriage rotatably connected to said undercarriage which support the vehicle on the support platform of the vehicle guideway, and wherein a propulsion plate movably positioned beneath the vehicle in the air duct of said vehicle guideway permits the vehicle to be propelled along the guideway in response to controlled air flow states in the air duct, an improved propulsion plate connector system comprising a vertical pylon for connecting the propulsion plate in the air duct of the vehicle guideway to a wheel carriage of the pneumatically propelled vehicle through the pylon guide slot of the vehicle guideway support platform, said pylon having a top end for connecting to the wheel carriage, a bottom end for connecting to a propulsion plate in the air duct of said vehicle guideway, and a vertical axis, a horizontal stabilizing beam for counteracting torque about said pylon produced by propulsion forces on said propulsion plate, said stabilizing beam having a base end connected to the top end of said pylon and a distal end connected to the vehicle, a pylon joint at said wheel carriage for removably connecting the top end of said pylon to said wheel carriage, said pylon joint fixing the rotational position of said pylon and the propulsion plate connected thereto about the vertical axis of the pylon such that the propulsion plate in the air duct of the vehicle guideway follows rotation of wheel carriage relative to the undercarriage of the vehicle, and a stabilizing beam joint proximate said pylon joint for joining the base end of said stabilizing beam to the top end of said pylon, said stabilizing beam joint providing a horizontal pivot connection between said stabilizing beam and said pylon so as to permit horizontal articulation of the stabilizing beam relative to the vertical axis of said pylon during rotation of the wheel carriage relative to the undercarriage of the vehicle.

2. The improved propulsion plate connector system of claim 1 wherein said pylon joint permits vertical articulation of the pylon and stabilizing beam at the pylon joint relative the vehicle's wheel carriage so as to permit the wheel carriage to readily follow vertical curves in the vehicle guideway.

3. The improved propulsion plate connector system of claim 1 wherein said stabilizing beam joint is positioned horizontally in front of said pylon joint to the outside of the wheel carriage.

4. The improved propulsion plate connector system of claim 1 wherein the wheel carriage of the vehicle to which the pylon is connected has at least two longitudinally spaced wheel sets, wherein each of said wheel sets has a defined wheel axis, and wherein said pylon joint is located proximate the wheel axis of one of said wheel sets so as to position the propulsion plate connected to the bottom end of said pylon in approximate vertical alignment with said wheel axis.

5. The improved propulsion plate connector system of claim 4 wherein the vertical pylon is longitudinally offset relative to the propulsion plate so as to pass through the guide slot of the vehicle guideway ahead of the propulsion plate, and wherein the structure formed by the pylon and propulsion plate is centered below the wheel axis so that both the pylon and propulsion plate are in approximate vertical alignment with said wheel axis.

6. The improved propulsion plate connector system of claim 4 wherein said wheel carriage has a static wheel axle defining a wheel axis, and wherein a pylon connector assembly is provided to connect the top end of said pylon to said static wheel axle.

7. The improved propulsion plate connector system of claim 6 wherein said pylon connector assembly includes vibration damping means for isolating the vertical pylon and horizontal stabilizing beam connected thereto from the wheel carriage of the vehicle to which the pylon is connected.

8. The improved propulsion plate connector system of claim 6 wherein said pylon connector assembly includes a pair of axle connector plates having a projecting end for capturing and holding said pylon at the pylon joint and an axle end for joining to the wheel axle to which said pylon is connected.

9. In a pneumatic transportation system which includes a vehicle guideway having a vehicle support platform, an air duct beneath said support platform, and a pylon guide slot in said support platform, and which further includes a pneumatically propelled vehicle having an undercarriage and wheel carriages rotatably connected to said undercarriage which support the vehicle on the support platform of the vehicle guideway, each of said wheel carriages having at least one wheel set having a defined wheel axis, and wherein a propulsion plate movably positioned beneath the vehicle in the air duct of said vehicle guideway permits the vehicle to be propelled in response to controlled air flow states in the air duct, an improved propulsion plate connector system comprising a vertical pylon for connecting the propulsion plate in the air duct of the vehicle guideway to one of the wheel carriages of the pneumatically propelled vehicle through the pylon guide slot of the vehicle guideway support platform, said pylon having a top end for connecting to said wheel carriage, a bottom end for connecting to a propulsion plate in the air duct of said vehicle guideway, and a vertical axis, and a pylon joint at said wheel carriage for removably connecting the top end of said pylon to the wheel carriage, said pylon joint fixing the rotational position of said pylon and the propulsion plate connected thereto about the vertical axis of the pylon such that the propulsion plate in the air duct of the vehicle guideway follows the rotation of said wheel carriage relative to the undercarriage of the vehicle, and wherein said pylon further positions the propulsion plate in approximate vertical alignment with the wheel axis of said wheel carriage.

10. The improved propulsion plate connector system of claim 9 wherein said pylon joint permits vertical articulation of the pylon at the pylon joint relative the vehicle's wheel carriage so as to permit the wheel carriage to readily follow vertical curves in the vehicle guideway.

11. The improved propulsion plate connector system of claim 9 wherein the wheel truck to which said pylon is connected has a static wheel axle defining a wheel axis, and wherein said improved propulsion plate connector system further includes a pylon connector assembly for connecting the top end of said pylon to said static wheel axle and to provide a pylon joint at said wheel carriage.

12. The improved propulsion plate assembly of claim 11 wherein said pylon connector assembly includes bracing means connected to said wheel carriage for reducing loads on the static axle of said wheel carriage.

13. The improved propulsion plate system of claim 11 wherein said pylon connector assembly includes a first collar assembly affixed to said static axle for holding said pylon to said static axle.

14. The improved propulsion plate system of claim 13 wherein said collar assembly includes an outer jacket, means for connecting the top end of said pylon to said outer jacket, and at least one cushion element between the static axle and said outer jacket.

15. The improved propulsion plate connector system of claim 14 wherein the means for connecting the top end of said pylon to the outer metal jacket of said collar assembly includes a pair of axle connector plates having a projecting end for capturing and holding the top end of said pylon at the pylon joint and an axle end joined to the outer jacket of said first collar assembly.

16. The improved propulsion plate connector system of claim 15 wherein said pylon connector assembly includes a removable pivot pin assembly inserted through the projecting ends of said connector plates and the top end said pylon to form said pylon joint.

17. The improved propulsion plate connector system of claim 16 wherein said axle connector plates extend longitudinally from the wheel carriage so as to position said pylon joint in front of said wheel carriage.

18. The improved propulsion plate connector system of claim 13 wherein the wheel carriage to which said pylon is connected includes a crossbeam structure in longitudinal spaced relation to the static axle of said wheel carriage, and wherein said pylon connector assembly further includes a second collar assembly secured to said crossbeam structure and at least one longitudinal bracing beam secured between the first collar assembly for said static axle and the second collar assembly for said crossbeam structure.

19. The improved propulsion plate system of claim 18 wherein said first collar assembly for the static axle includes an outer jacket and at least one cushion element between the static axle and the outer jacket of said first collar assembly, and said second collar assembly includes an outer jacket and at least one cushion element between the crossbeam structure and the outer jacket of said second collar assembly, and wherein said longitudinal bracing beam is secured to the outer jackets of said first and second collar assemblies.

20. The improved propulsion plate connector system of claim 9 wherein the vertical pylon is longitudinally offset relative to the propulsion plate so as to pass through the guide slot of the vehicle guideway ahead of the propulsion plate, and wherein the structure formed by the pylon and propulsion plate is centered below the wheel axis so that both the pylon and propulsion plate are in approximate vertical alignment with said wheel axis.

21. In a pneumatic transportation system which includes a vehicle guideway having a vehicle support platform, an air duct beneath said support platform, and a pylon guide slot in said support platform, a pneumatically propelled vehicle comprising an undercarriage, wheel carriages rotatably connected to said undercarriage which support the vehicle on the support platform of the vehicle guideway, each of said wheel carriages having at least one wheel set having a defined wheel axis, at least one propulsion plate movably positionable in the air duct of said vehicle guideway, and a pylon connecting said propulsion plate to one of said wheel carriages in approximate vertical alignment with the wheel axis of said wheel carriage.

22. The pneumatically propelled vehicle of claim 21 wherein both the pylon and propulsion plate are in approximate vertical alignment with said wheel axis.

23. The pneumatically propelled vehicle of claim 21 wherein the vehicle includes a wheel carriage having a static axle defining a wheel axis and wherein said pylon holds said propulsion plate to and in approximate vertical alignment with said static axle.

24. A method propelling a vehicle of a pneumatic transportation system through curves of a vehicle guideway having a support platform, a track on the support platform, an air duct below the support platform, and a sealed guide slot in and along the support platform, said method comprising providing the vehicle with wheel carriages which rotate relative to the undercarriage of the vehicle in a horizontal curve in the guideway, each of said wheel carriages having at least one defined wheel axis, providing at least one propulsion plate in the air duct of said guideway and connecting said propulsion plate to one of the wheel carriages of the vehicle though the guide slot in the support platform of the vehicle guideway, propelling the vehicle on the track of the guideway support platform by controlling the airflow states in the guideway air duct, and causing the propulsion plate to follow the rotation of the wheel carriage to which it is connected and to travel in approximate vertical alignment with the wheel axis of said wheel carriage so as to maintain a centered relation between the propulsion plate and the guideway air duct in horizontal curves of the vehicle guideway.

25. The method of claim 24 wherein said propulsion plate is connected to a wheel carriage of said vehicle by a pylon extending through the guide slot of the guideway support platform, and wherein said pylon is also caused to travel in approximate vertical alignment with the wheel axis of the wheel carriage to which it is connected so as to maintain a centered relation between the pylon and guideway guide slot in horizontal curves.

26. The method of claim 25 wherein the pylon leads the propulsion plate through horizontal curves to minimize air leakage through the sealed guide slot of the guideway support platform.

27. The method of claim 25 wherein the propulsion plate and pylon are caused to articulate in the longitudinal vertical plane relative to the wheel carriage when the wheel carriage enters and exits a vertical curve in the guideway whereby contact between the wheels of the wheel carriage and the track of the guideway support platform is maintained.

* * * * *